US012532967B2

(12) United States Patent
Choi

(10) Patent No.: US 12,532,967 B2
(45) Date of Patent: Jan. 27, 2026

(54) FOLDABLE STAND WITH IMPROVED STABILITY

(71) Applicant: Campvalley Co., Ltd., Xiamen (CN)

(72) Inventor: Kwan Jun Choi, Xiamen (CN)

(73) Assignee: Campvalley Co., Ltd., Xiamen (CN)

( * ) Notice: Subject to any disclaimer, the term of this patent is extended or adjusted under 35 U.S.C. 154(b) by 218 days.

(21) Appl. No.: 18/456,904

(22) Filed: Aug. 28, 2023

(65) Prior Publication Data

US 2024/0090675 A1 Mar. 21, 2024

(30) Foreign Application Priority Data

Sep. 19, 2022 (CN) ..... 202222477736.0

(51) Int. Cl.
*A47C 19/14* (2006.01)
*A47C 17/72* (2006.01)
*A47C 19/12* (2006.01)

(52) U.S. Cl.
CPC ..... *A47C 17/72* (2013.01); *A47C 19/126* (2013.01)

(58) Field of Classification Search
CPC ..... A47C 17/70; A47C 17/72; A47C 17/74; A47C 19/14; A47C 19/12; A47C 19/122; A47C 19/126; A47C 19/128
See application file for complete search history.

(56) References Cited

U.S. PATENT DOCUMENTS

| | | | | |
|---|---|---|---|---|
| 7,661,159 | B1 * | 2/2010 | Chen | A47C 17/72 5/116 |
| 7,698,756 | B1 * | 4/2010 | Chen | A47C 17/72 135/96 |
| D842,959 | S * | 3/2019 | Choi | D21/834 |
| D850,557 | S * | 6/2019 | Choi | D21/834 |
| D851,193 | S * | 6/2019 | Choi | D21/834 |
| D852,915 | S * | 7/2019 | Choi | D21/834 |
| D852,916 | S * | 7/2019 | Choi | D21/834 |
| 11,700,949 | B1 * | 7/2023 | Zhu | A47C 17/72 5/116 |
| 2010/0205737 | A1 * | 8/2010 | Peterson | A47C 17/72 5/110 |
| 2010/0287699 | A1 * | 11/2010 | Brune | A47C 17/70 5/111 |
| 2010/0293714 | A1 * | 11/2010 | Choi | A47C 19/126 5/112 |
| 2012/0047649 | A1 * | 3/2012 | Grace | A47C 17/64 5/115 |
| 2012/0317717 | A1 * | 12/2012 | Jin | A47C 17/72 5/110 |

(Continued)

*Primary Examiner* — Justin C Mikowski
*Assistant Examiner* — Ifeolu A Adeboyejo
(74) *Attorney, Agent, or Firm* — MORGAN, LEWIS & BOCKIUS LLP

(57) ABSTRACT

A foldable stand includes first and second supports, each having first and second portions. The foldable stand also includes first and second leg assemblies, each having a pair of crossed bars. The pair of crossed bars of the first leg assembly is pivotally connected to the first portions of the first and second supports. The pair of crossed bars of the second leg assembly is pivotally connected to the second portions of the first and second supports. The foldable stand further includes at least one locking assembly to selectively lock the pair of crossed bars of the first or second leg assembly to prevent the foldable stand from accidental folding.

18 Claims, 4 Drawing Sheets

(56) References Cited

U.S. PATENT DOCUMENTS

| | | | | |
|---|---|---|---|---|
| 2017/0215598 | A1* | 8/2017 | Choi | A47C 19/04 |
| 2017/0295940 | A1* | 10/2017 | Choi | A47C 17/70 |
| 2019/0029435 | A1* | 1/2019 | Choi | A47C 19/128 |
| 2019/0167009 | A1* | 6/2019 | Huang | A47C 19/14 |
| 2020/0315361 | A1* | 10/2020 | Wang | A47C 19/14 |
| 2020/0337468 | A1* | 10/2020 | Choi | F16B 7/105 |
| 2023/0049345 | A1* | 2/2023 | Jung | A47C 19/122 |
| 2023/0404253 | A1* | 12/2023 | Ma | A47B 3/0912 |

* cited by examiner

FOLDABLE STAND WITH IMPROVED STABILITY

CROSS-REFERENCE TO RELATED APPLICATIONS

The present application claims priority to Chinese Application CN 202222477736.0 filed Sep. 19, 2022. The disclosure of the application is incorporated herein for all purposes by reference in its entirety.

FIELD OF THE INVENTION

The present invention generally relates to foldable stands and, in particular, to foldable stands with improved stability.

BACKGROUND

Foldable beds are becoming more and more popular because of their ease to use and portability. A typical foldable bed usually includes a foldable stand to support a mattress, a panel, a bed cloth or the like. Some stands include pairs of crossed bars and can be folded like an umbrella when not in use. These stands and beds are widely used in home, office and other places due to their light weight and small folded size. However, crossed bars are prone to folding inwards during use. This can lead to accidental folding of the stands and collapse of the beds.

Given the current state of the art, there remains a need for foldable stands and beds that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable stands and beds with locking assemblies to improve stability.

In various exemplary embodiments, the present disclosure provides a foldable stand including a first support and a second support. Each of the first and second supports includes a first portion and a second portion. The foldable stand also includes a first leg assembly and a second leg assembly, each having a pair of crossed bars. An upper end of a first crossed bar in the pair of crossed bars of the first leg assembly is pivotally connected to the first portion of the second support. An upper end of a second crossed bar in the pair of crossed bars of the first leg assembly is pivotally connected to the first portion of the first support. An upper end of a first crossed bar in the pair of crossed bars of the second leg assembly is pivotally connected to the second portion of the second support. An upper end of a second crossed bar in the pair of crossed bars of the second leg assembly is pivotally connected to the second portion of the first support. The foldable stand further includes at least one locking assembly to selectively lock the pair of crossed bars of the first or second leg assembly, thereby allowing the foldable stand to fold and unfold when unlocked and preventing the foldable stand from accidental folding when locked.

In some exemplary embodiments, the first and second leg assemblies are substantially the same.

In some exemplary embodiments, the first or second leg assembly further includes a first leg, a second leg, a first base and a second base. In some such embodiments, an upper end of the first leg is pivotally connected to the first or second portion of the first support. A lower end of the first leg is connected to the first base. A lower end of the first crossed bar is pivotally connected to the first base. An upper end of the second leg is pivotally connected to the first or second portion of the second support. A lower end of the second leg is connected to the second base. A lower end of the second crossed bar is pivotally connected to the second base.

In some exemplary embodiments, the upper end of the first or second leg pivots along a first axis substantially parallel to a lateral direction of the foldable stand. The upper end of the first or second crossed bar pivots along a second axis substantially parallel to a longitudinal direction of the foldable stand.

In some exemplary embodiments, the upper end of the first leg is spaced apart from the upper end of the second crossed bar along a longitudinal direction of the foldable stand. The upper end of the second leg is spaced apart from the upper end of the first crossed bar along the longitudinal direction of the foldable stand.

In some exemplary embodiments, the at least one locking assembly includes a first locking assembly connected to the pair of crossed bars of the first leg assembly to selectively lock the pair of crossed bars of the first leg assembly relative to each other.

In some exemplary embodiments, the first locking assembly includes a first locking bar and a second locking bar. The first locking bar is pivotally connected to the first crossed bar in the pair of crossed bars of the first leg assembly. The second locking bar is pivotally connected to the second crossed bar in the pair of crossed bars of the first leg assembly. The first and second locking bars are movably coupled with each other, thereby allowing the first locking assembly to adjust its length. The first locking assembly also includes a locking/unlocking mechanism to selectively restrict the first and second locking bars from moving with respect to each other.

In some exemplary embodiments, the first locking bar is pivotally connected to the lower end of the first crossed bar, and the second locking bar is pivotally connected to an upper portion of the second crossed bar.

In some exemplary embodiments, the first locking bar is pivotally connected to the upper portion of the first crossed bar, and the second locking bar is pivotally connected to the lower end of the second crossed bar.

In some exemplary embodiments, one of the first and second locking bars is an outer tubular bar, and the other of the first and second locking bars is an inner bar that is slidably coupled with the outer tubular bar and includes one or more cuts. In some such embodiments, the locking/unlocking mechanism is disposed at the outer tubular bar and includes a fastener to selectively engage with a cut in the one or more cuts, thereby selectively restricting the first and second locking bars from moving with respect to each other and consequently locking the pair of crossed bars of the first leg assembly.

In some exemplary embodiments, the locking/unlocking mechanism further includes a button to disengage the fastener from the cut, thereby allowing the first and second locking bars to move relative to each other and consequently allowing the foldable stand to fold and unfold.

In some exemplary embodiments, a cut in the one or more cuts is a slot formed on an edge of the inner bar.

In some exemplary embodiments, at least a portion of the inner bar is tubular and the cut is a hole formed on a side wall of the tubular portion of the inner bar.

In some exemplary embodiments, the at least one locking assembly includes a second locking assembly connected to the pair of cross bars of the second leg assembly to selectively lock the pair of cross bars of the second leg assembly relative to each other.

In some exemplary embodiments, the second locking assembly is substantially the same as the first locking assembly.

In some exemplary embodiments, the first and second portions of each of the first and second supports are pivotally coupled with each other at proximal sides thereof, thereby allowing the first and second portions to fold and unfold with respect to each other.

In some exemplary embodiments, the foldable stand further includes a third leg assembly pivotally coupled with the proximal sides of the first and second portions of each of the first and second supports.

In some exemplary embodiments, the third leg assembly includes a pair of crossed legs, one having an upper end pivotally coupled with the proximal sides of the first and second portions of the first support and the other having an upper end pivotally coupled with the proximal sides of the first and second portions of the second support.

In some exemplary embodiments, the third leg assembly further includes a pair of links, each having an upper end coupled with an upper portion of one crossed leg and a lower end coupled with another crossed leg.

In various exemplary embodiments, the present disclosure provides a foldable stand including a first support, a second support, a first leg assembly and a second leg assembly. The first and second leg assemblies are connected to the first and second supports for supporting the first and second supports when the foldable stand is unfold. The first or second leg assembly includes a first bar, a second bar, a first leg and a second leg. The first and second bars are pivotally connected with each other at their middle portions. An upper end of the first bar is pivotally connected to the second support. An upper end of the second bar is pivotally connected to the first support. An upper end of the first leg is pivotally connected to the first support and spaced apart from the upper end of the second bar along a length direction of the first support. An upper end of the second leg is pivotally connected to the second support and spaced apart from the upper end of the first bar along a length direction of the second support. A lower end of the first bar and a lower end of the first leg are pivotally connected to each other. A lower end of the second bar and a lower end of the second leg are pivotally connected to each other. The foldable stand also includes a locking assembly having a first end pivotally connected to the first bar and a second end pivotally connected to the second bar. The locking assembly has a length that is selectively adjustable, thereby allowing the foldable stand to fold and unfold and preventing the foldable stand from accidental folding.

The foldable stands of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
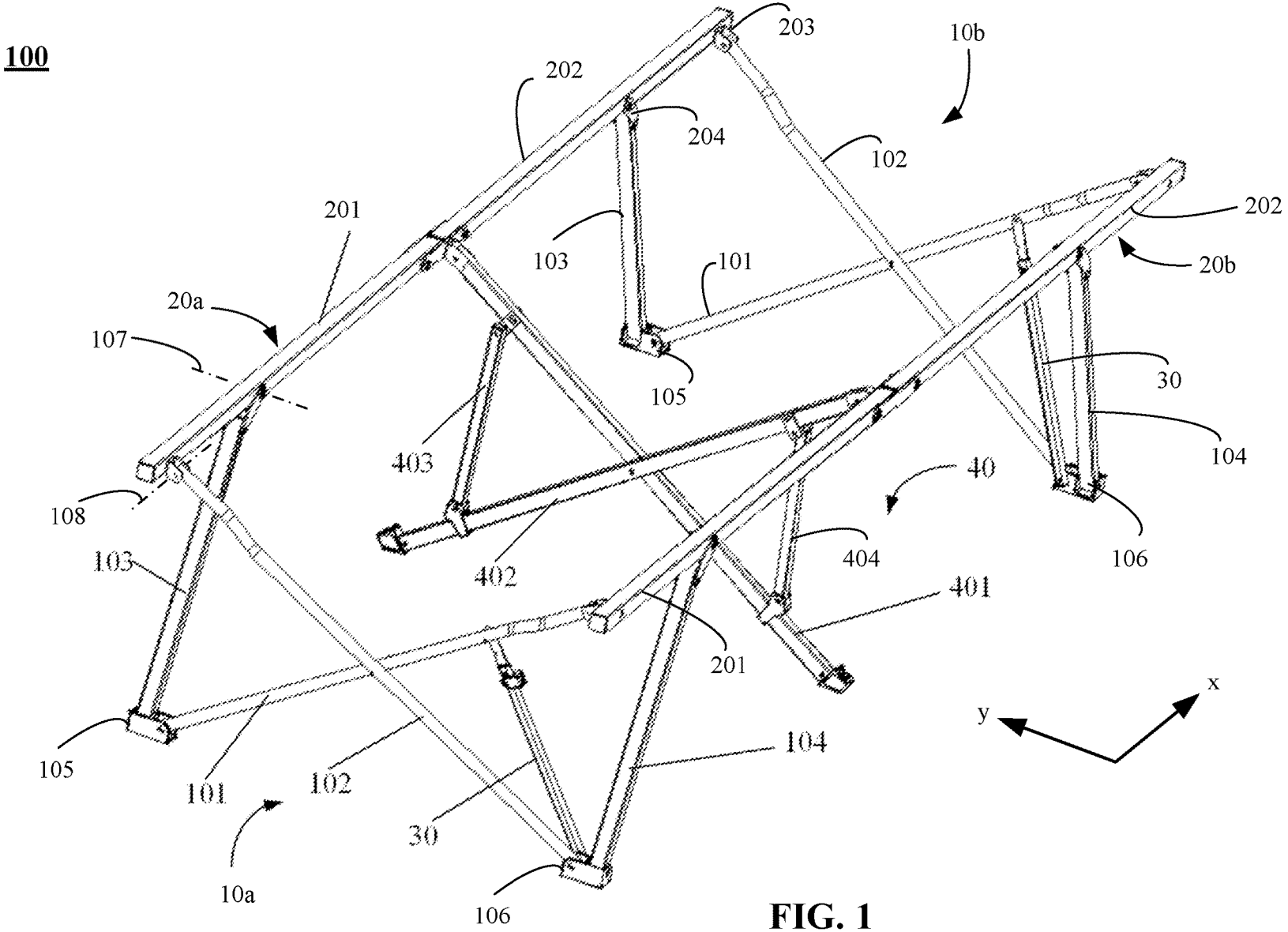
FIG. 1 is a perspective view schematically illustrating an exemplary foldable stand in accordance with some exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable stands with locking assemblies to improve stability. The foldable stands can be used to make beds or the like. In addition, the foldable stands can be made of various materials including but not limited to metals (e.g., iron, steel, and aluminum), plastics and woods. In some exemplary embodiments, some components of a stand are made of metals or the like while some other components are made of plastics, rubbers or the like.

A foldable stand of the present disclosure generally includes first and second supports, first and second leg assemblies, and at least one locking assembly. The first and second leg assemblies are connected to the first and second supports for supporting the first and second supports when the foldable stand is unfold. The first or second leg assembly includes a pair of crossed bars, with one crossed bar having an upper end pivotally connected to the first support and the other crossed bar having an upper end pivotally connected to the second support. In some exemplary embodiments, the first or second leg assembly also includes a first leg having an upper end pivotally connected to the first support and a second leg having an upper end pivotally connected to the second support. The at least one locking assembly is configured to selectively lock the pair of crossed bars of the first or second leg assembly, thereby allowing the foldable stand to fold and unfold when unlocked and preventing the foldable stand from accidental folding when locked.

As used herein, a pair of crossed bars generally refers to two bars pivotally connected to each other at their middle portions. The two bars can be but do not have to be identical or symmetrical to each other, and can be either solid or hollow with any suitable shapes and sizes. The pivotal connection can be but do not have to be at the middle point of each bar. When the pair of crossed bar is locked, the two bars cannot move relative to each other, e.g., the angle between the two bars is fixed and the two bars cannot fold inwardly or outwardly.

Figure 2:
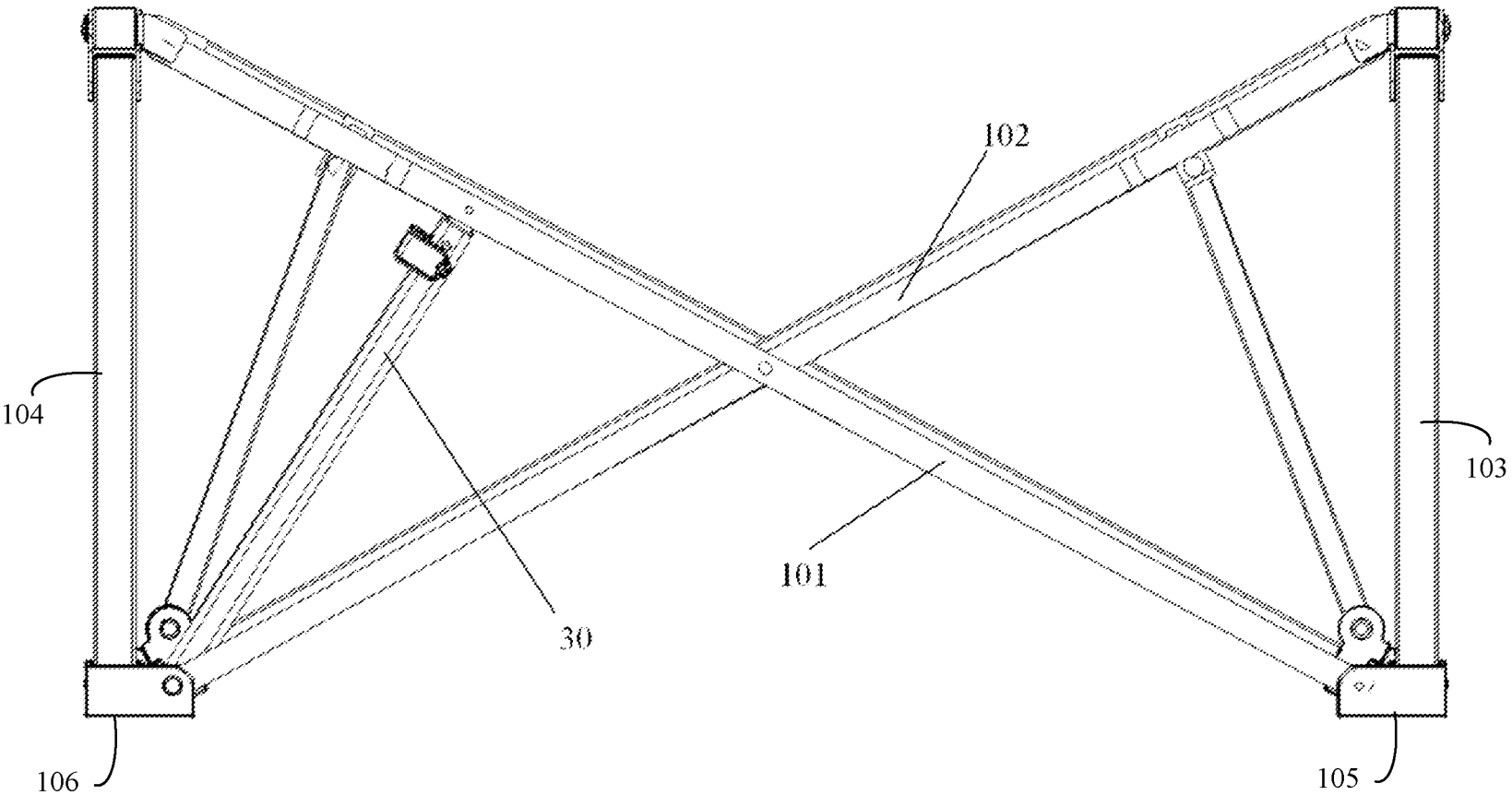
FIG. 2 is a side view schematically illustrating the exemplary foldable stand of FIG. 1.

Referring to FIGS. 1 and 2, there is depicted an exemplary foldable stand 100 in accordance with some exemplary embodiments of the present disclosure. Foldable stand 100 includes a first support, such as first support 20*a*, and a second support, such as second support 20*b*. The first and second supports can be but do not necessarily have to be identical or symmetric with respect to each other. As a non-limiting example, FIG. 1 illustrates that first support 20*a* and second support 20*b* are substantially the same and disposed symmetrically with respect to each other when the foldable stand is unfolded. In some exemplary embodiments, when the foldable stand is unfolded, the first and second supports are generally elongated along a longitudinal direction of the unfolded stand (e.g., x direction in FIG. 1) and/or are generally parallel to each other.

In some exemplary embodiments, each of the first and second supports includes a first portion, such as first portion 201, and a second portion, such as second portion 202. The first and second portions of the first support can be but do not necessarily have to be identical to the first and second portions of the second support. In some exemplary embodiments, the first portion and the second portion of the first support are pivotally coupled with each other at their proximal sides, for instance, by one or more couplers. Similarly, the first portion and the second portion of the second support are pivotally coupled with each other at their proximal sides. As such, the first portions of the first and second supports and the second portions of the first and second supports can be folded and unfolded with respect to each other. As used herein, the sides at which the first and second portions are connected to each other are referred to as their proximal sides, and the sides opposite the proximal sides are referred to as their distal sides. For instance, in FIG. 1, the proximal sides of the first and second portions are in the middle of the foldable stand. The distal sides correspond to the lower-left and upper-right sides of the figure. It should be noted that the term "middle" as used herein does not necessarily mean the center of the foldable stand, and the term "side" does not necessarily mean an outmost edge of the foldable stand.

The foldable stand includes one or more leg assemblies to support the first and second supports when the foldable stand is unfolded. For instance, in some exemplary embodiments, the foldable stand includes a first leg assembly 10*a* and a second leg assembly 10*b*. The first and second leg assemblies can be but do not necessarily have to be identical or symmetric with respect to each other. As a non-limiting example, FIG. 1 illustrates that first leg assembly 10*a* and second leg assembly 10*b* are substantially the same and disposed symmetrically with respect to each other when the foldable stand is unfolded.

In some exemplary embodiments, the first or second leg assembly includes a pair of crossed bars. In some exemplary embodiments, each of the first and second leg assemblies includes a pair of crossed bars. For instance, in some exemplary embodiments, the first or second leg assembly includes a first crossed bar, such as bar 101, and a second crossed bar, such as bar 102. Bar 101 and bar 102 are pivotally connected to each other at their middle portions and thus collectively form a pair of crossed bars. The first and second crossed bars can be but do not necessarily have to be identical or symmetrical with respect to each other. Also, the pair of crossed bars of the first leg assembly can be but do not necessarily have to be identical to the pair of crossed bars of the second leg assembly.

First leg assembly 10*a* is connected to the first portions of the first and second supports, and second leg assembly 10*b* is connected to the second portions of the first and second supports. For instance, in some exemplary embodiments, bar 101 (e.g., the first crossed bar in the pair of crossed bars) of first leg assembly 10*a* has an upper end pivotally connected to first portion 201 of second support 20*b*. Bar 102 (e.g., the second crossed bar in the pair of crossed bars) of first leg assembly 10*a* has an upper end pivotally connected to first portion 201 of first support 20*a*. Similarly, bar 101 of second leg assembly 10*b* has an upper end pivotally connected to second portion 202 of second support 20*b*, and bar 102 of second leg assembly 10*b* has an upper end pivotally connected to second portion 202 of first support 20*a*. In some exemplary embodiments, bar 101 is connected to the second support and bar 102 is connected to the first support through connectors, such as connector 203 or the like. In some exemplary embodiments, connector 203 is disposed at an interior side of the second support (e.g., the side facing the first support when the foldable stand is unfolded) or an interior side of the first support (e.g., the side facing the second support when the foldable stand is unfolded).

In some exemplary embodiments, the first or second leg assembly includes optionally or additional components. For instance, in some exemplary embodiments, the first or second leg assembly a first leg, such as leg 103, and a second leg, such as leg 104. In some exemplary embodiments, the first or second leg assembly includes a first base, such as base 105, and a second base, such as base 106. The first leg has an upper end pivotally connected to the first or second portion of the first support, and a lower end connected to the first base. For instance, in some exemplary embodiments, leg 103 of first leg assembly 10*a* has an upper end pivotally connected first portion 201 of first support 20*a* and a lower end connected to base 105 of first leg assembly 10*a*. Leg 103 of second leg assembly 10*b* has an upper end pivotally connected second portion 202 of first support 20*a* and a lower end connected to base 105 of second leg assembly 10*b*. Similarly, the second leg has an upper end pivotally connected to the first or second portion of the second support and a lower end pivotally connected to the second base. For instance, in some exemplary embodiments, leg 104 of first leg assembly 10*a* has an upper end pivotally connected first portion 201 of second support 20*b* and a lower end connected to base 106 of first leg assembly 10*a*. Leg 104 of second leg assembly 10*b* has an upper end pivotally connected second portion 202 of second support 20*b* and a lower end connected to base 106 of second leg assembly 10*b*. In some exemplary embodiments, leg 103 is connected to the first support and leg 104 is connected to the second support through connectors, such as connector 204 or the like. In some exemplary embodiments, connector 204 is configured such that at least a portion of connector 204 is disposed below the first or second support when the foldable stand is unfolded.

In some exemplary embodiments, the lower end of the first crossed bar is pivotally connected to the first base, and the lower end of the second crossed bar is pivotally connected to the second base. For instance, in some exemplary embodiments, the lower end of bar 101 of first leg assembly 10*a* is pivotally connected to base 105 of first leg assembly 10*a*, and lower end of bar 102 first leg assembly 10*a* is pivotally connected to base 106 of first leg assembly 10*a*. Similarly, the lower end of bar 101 of second leg assembly 10*b* is pivotally connected to base 105 of second leg assembly 10*b*, and lower end of bar 102 second leg assembly 10*b* is pivotally connected to base 106 of second leg assembly 10*b*.

In some exemplary embodiments, the upper end of the first or second leg pivots along a first axis substantially parallel to a lateral direction of the foldable stand, and the upper end of the first or second crossed bar pivots along a second axis substantially parallel to a longitudinal direction of the foldable stand. For instance, in some exemplary embodiments, the upper end of leg 105 of first leg assembly 10*a* pivots along axis 107 that is substantially parallel to a lateral direction of the foldable stand (e.g., y direction in FIG. 1). The upper end of bar 102 of first leg assembly 10*a* pivots along axis 108 that is substantially parallel to a longitudinal direction of the foldable stand (e.g., x direction in FIG. 1). In some exemplary embodiments, axis 107 and axis 108 are substantially perpendicular to each other. In some exemplary embodiments, the upper end of the first leg is spaced apart from the upper end of the second crossed bar, and the upper end of the second leg is spaced apart from the upper end of the first crossed bar. For instance, the upper end of leg 105 of first leg assembly 10*a* is spaced apart from the upper end of bar 102 of first leg assembly 10*a*, and the upper end of leg 106 of first leg assembly 10*a* is spaced apart from the upper end of bar 101 of first leg assembly 10*a* along the longitudinal direction of the foldable stand.

In various exemplary embodiments, the foldable stand includes at least one locking assembly to selectively lock the pair of crossed bars of the first or second leg assembly, thereby allowing the foldable stand to fold and unfold when unlocked and preventing the foldable stand from accidental folding when locked. As a non-limiting example, FIG. 1 illustrates two locking assemblies 30, one configured to selectively lock the pair of crossed bars (e.g., bars 101 and 102) of first leg assembly 10*a* and the other configured to selectively lock the pair of crossed bars of second leg assembly 10*b*. While the two locking assemblies are illustrated to be on a side adjacent to the second support, it should be noted that this is by way of example and the present disclosure is not limited thereto. Indeed, the two locking assemblies can be disposed on a side adjacent to the first support, or one on each side. In addition, the foldable stand do not have to have two locking assemblies. The foldable stand can include any suitable number of locking assemblies. For instance, in some exemplary embodiments, the foldable stand consists of a single locking assembly, e.g., either one of the two locking assemblies illustrated in FIG. 1, to selectively lock the pair of crossed bars of the first or second leg assembly. In some exemplary embodiments such as those in FIG. 1, the foldable stand includes two locking assemblies, one configured to selectively lock the pair of crossed bars of the first leg assembly and the other configured to selectively lock the pair of crossed bars of the second leg assembly. In some exemplary embodiments, the foldable stand includes more than two locking assemblies, where the pair of crossed bars of the first or second leg assembly is selectively locked by at least two locking assemblies. In some exemplary embodiments, the foldable stand includes a locking assembly to selectively lock an additional leg assembly (e.g., third leg assembly 40 disclosed herein). In embodiments with multiple locking assemblies, the locking assemblies can be configured the same as or differently from each other.

In some exemplary embodiments, locking assembly 30 is pivotally connected to each crossed bar in the pair of crossed bars. The pivotal connection of the locking assembly 30 with a crossed bar can be direct or indirect. For instance, in some exemplary embodiments, locking assembly 30 has one end pivotally connected to bar 101 and another end pivotally connected to base 106, to which bar 102 is connected.

In some exemplary embodiments, locking assembly 30 includes a first locking bar, a second locking bar and a locking/unlocking mechanism. The first locking bar is pivotally connected to one of the crossed bars of a respective leg assembly (e.g., the first or second leg assembly), and the second locking bar is pivotally connected to the other of the crossed bars of the respective leg assembly. The first and second locking bars are movably coupled with each other, thereby allowing the locking assembly to adjust its length. This allows the crossed bars to open and close, which in turn allows the first and second supports to fold and unfold. In some exemplary embodiments, one of the first and second locking bars is an outer tubular bar (e.g., at least a portion of the bar is hollow), and the other of the first and second locking bars is an inner bar that is slidably coupled with the outer tubular bar. The locking/unlocking mechanism is configured to selectively restrict the first and second locking bars from moving with respect to each other. This locks the crossed bars relative to each other, which in turn locks the leg assembly as well as the first and second supports. Consequently, this prevents accidental folding of the foldable stand.

In some exemplary embodiments, locking assembly 30 is disposed at a side adjacent to second support 20*b*. In some such embodiments, the first locking bar is pivotally connected to the upper portion of the first crossed bar (e.g., bar 101), and the second locking bar is pivotally connected to the lower end of the second crossed bar (e.g., bar 102), directly or indirectly (e.g., through base 106). In some exemplary embodiments, locking assembly 30 is disposed at a side adjacent to first support 20*a*. In some such embodiments, the first locking bar is pivotally connected to the lower end of the first crossed bar, directly or indirectly (e.g., through base 105), and the second locking bar is pivotally connected to an upper portion of the second crossed bar.

Figure 3:
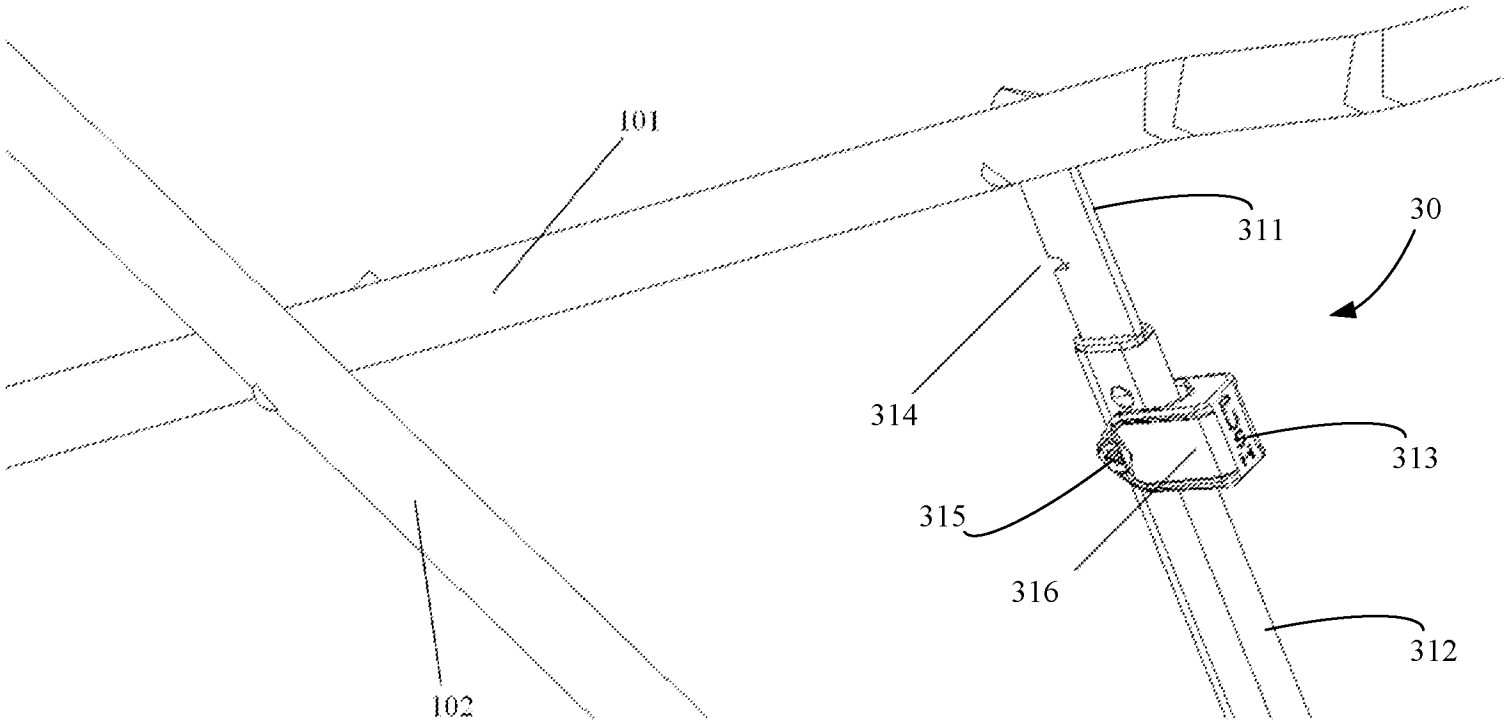
FIG. 3 is an enlarged view schematically illustrating an exemplary locking assembly in accordance with some exemplary embodiments of the present disclosure.

For instance, as a non-limiting example, FIG. 3 illustrates locking assembly 30 including first locking bar 311, second locking bar 312 and locking/unlocking mechanism 313. First locking bar 311 is pivotally connected to bar 101 and second locking bar 312 is pivotally connected to bar 102 (e.g., via base 106 shown in FIGS. 1 and 2). First locking bar 311 and second locking bar 312 are movably coupled with each other to allow locking assembly 30 to adjust its length. In some exemplary embodiments, second locking bar 312 is an outer tubular bar and first locking bar 311 is an inner bar slidably coupled with second locking bar 312. First locking bar 311 can be tubular or non-tubular. In some exemplary embodiments, first locking bar 311 includes one or more cuts, such as cut 314. In some exemplary embodiments, cut 314 is a slot formed on an edge of first locking bar 311.

Locking/unlocking mechanism 313 is configured to selectively restrict the first and second locking bars from moving with respect to each other, e.g., to selectively not allow locking assembly 30 to adjust its length. For instance, in some exemplary embodiments, locking/unlocking mechanism 30 is disposed at second locking bar 312 (e.g., the outer tubular bar). Locking/unlocking mechanism 30 includes a fastener, such as fastener 315, to selectively engage with a cut 314 in the one or more cuts, thereby selectively restricting the first and second locking bars from moving with respect to each other and consequently locking the pair of crossed bars of the respective leg assembly. In some exemplary embodiments, there are a plurality of cuts spaced apart along the length direction of first locking bar 311. This allows for selectively locking the pair of crossed bars at different positions, and consequently for placing the foldable stand at different heights.

In some exemplary embodiments, locking/unlocking mechanism 30 further includes a button, such as button 316. Button 316 is configured to disengage the fastener from the cut, for instance, by pushing the button toward second locking bar 312. Disengaging the fastener from the cut allows the first and second locking bars to move relative to each other and consequently allows the foldable stand to fold and unfold.

Figure 4:
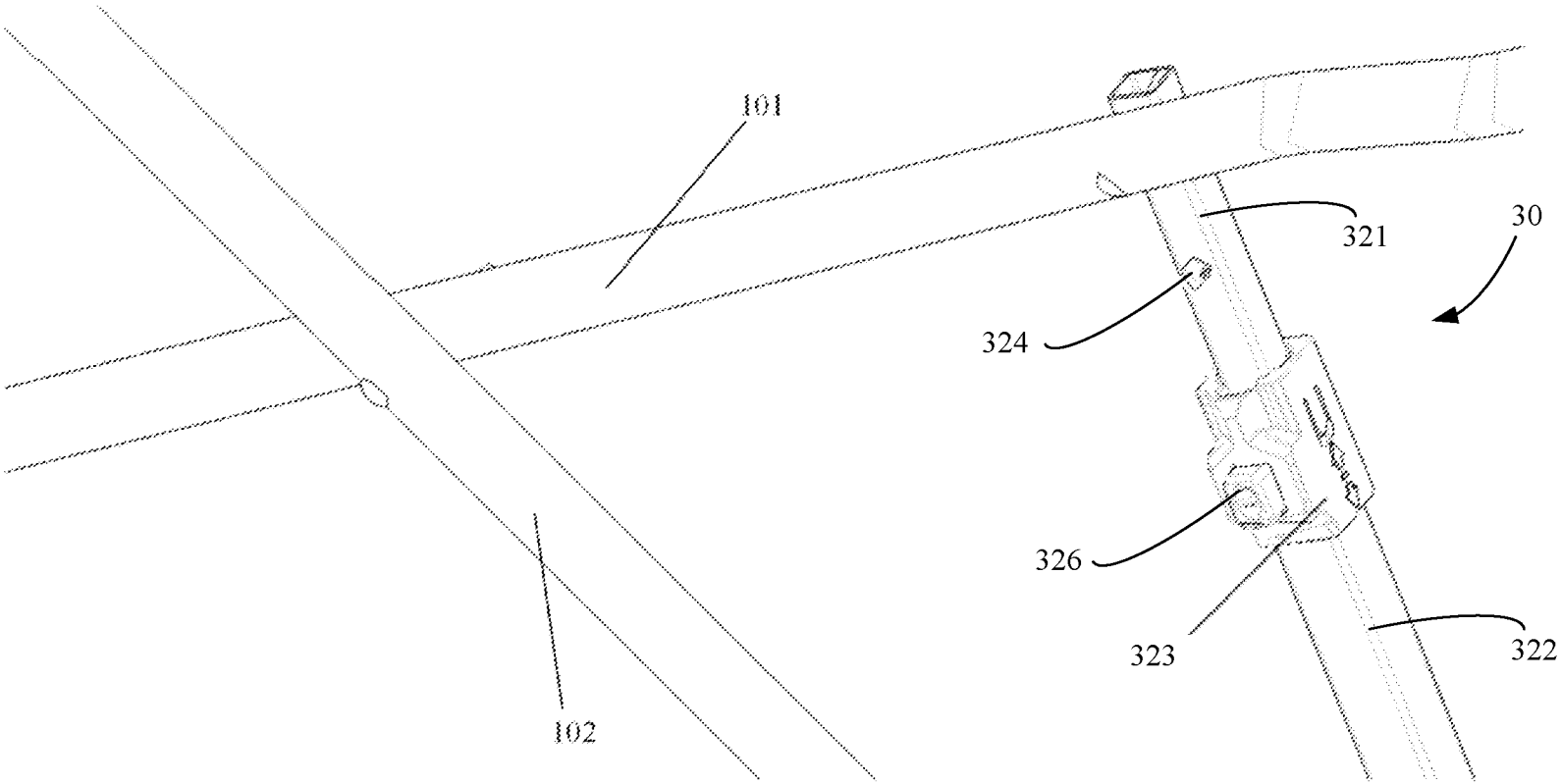
FIG. 4 is an enlarged view schematically illustrating another exemplary locking assembly in accordance with some exemplary embodiments of the present disclosure.

As another non-limiting example, FIG. 4 illustrates locking assembly 30 including first locking bar 321, second locking bar 322 and locking/unlocking mechanism 323. First locking bar 321 is pivotally connected to bar 101 and second locking bar 322 is pivotally connected to bar 102 (e.g., via base 106 shown in FIGS. 1 and 2). First locking bar 321 and second locking bar 322 are movably coupled with each other to allow locking assembly 30 to adjust its length. In some exemplary embodiments, second locking bar 322 is an outer tubular bar and first locking bar 321 is an inner bar slidably coupled with second locking bar 322. In some exemplary embodiments, at least a portion of first locking bar 321 is tubular and includes one or more cuts, such as cut 324. In some exemplary embodiments, cut 324 is a hole formed on a side wall of the tubular portion of first locking bar 321.

Locking/unlocking mechanism 323 is configured to selectively restrict the first and second locking bars from moving with respect to each other, e.g., to selectively not allow locking assembly 30 to adjust its length. For instance, in some exemplary embodiments, locking/unlocking mechanism 30 is disposed at second locking bar 322 (e.g., the outer tubular bar). Locking/unlocking mechanism 30 includes a fastener, such as a pin, to selectively engage with a cut 324 in the one or more cuts, thereby selectively restricting the first and second locking bars from moving with respect to each other and consequently locking the pair of crossed bars of the respective leg assembly. In some exemplary embodiments, there are a plurality of cuts spaced apart along the length direction of first locking bar 321. This allows for selectively locking the pair of crossed bars at different positions, and consequently for placing the foldable stand at different heights.

In some exemplary embodiments, locking/unlocking mechanism 30 further includes a button, such as button 326. Button 326 is configured to disengage the fastener from the cut, for instance, by pulling the button to pull the pin out of cut (hole) 324 of first locking bar 321. Disengaging the fastener from the cut allows the first and second locking bars to move relative to each other and consequently allows the foldable stand to fold and unfold.

Examples of adjustable bars that can be used as a locking assembly are disclosed in U.S. Pat. No. 11,357,334 B2, U.S. Pat. No. 11,076,703 B2, and U.S. Pat. No. 11,700,950 B2, the content of each is incorporated herein for all purposes by reference in its entirety. In addition, locking/unlocking assemblies can be configured in other ways. For instance, a locking assembly can be configured to allow adjustment of its length continuously non-continuously or in a hybrid manner. Also, a locking assembly can be a collapsible or foldable link assembly. In some exemplary embodiments, a collapsible or foldable link assembly includes a first linking member and a second linking member. The first and second linking members are pivotally connected to each other at their proximal ends. The distal end of the first linking member is pivotally connected to the first crossed bar (e.g., bar 101) and the distal end of the second linking member is pivotally connected to the second crossed bar (e.g., bar 102). Preferably, the pivotal connection of the first linking member with the first crossed bar is at or adjacent to an end of the first crossed bar. Similarly, the pivotal connection of the second linking member with the second crossed bar is at or adjacent to an end of the second crossed bar.

In some exemplary embodiments, the foldable stand includes one or more additional leg assemblies to help support the first and second supports when the foldable stand is unfolded. The foldable stand can include any suitable number of additional leg assemblies and an additional assembly can be configured the same as the first or second leg assembly or differently from the first or second leg assembly. As a non-limiting example, FIG. 1 illustrates the foldable stand includes a third leg assembly 40 disposed between the first and second leg assemblies when the foldable stand is unfolded.

In some exemplary embodiments, third leg assembly 40 is pivotally coupled with the proximal sides of the first and second portions of each of the first and second supports. For instance, in some exemplary embodiments, third leg assembly 40 includes a pair of crossed legs formed by leg 401 and leg 402, which are pivotally coupled with each other at their middle portions. Leg 401 has an upper end pivotally coupled with the proximal sides of the first and second portions of first support 20*a*, and leg 402 has an upper end pivotally coupled with the proximal sides of the first and second portions of second support 20*b*. In some exemplary embodiments, third leg assembly 40 further includes one or more links, such as link 403 and/or link 404. In some exemplary embodiments, link 403 has an upper end coupled with an upper portion of leg 401 and a lower end coupled with leg 402. Similarly, link 404 has an upper end coupled with an upper portion of leg 402 and a lower end coupled with leg 401. In some exemplary embodiments, link 403 or 404 is slidably or pivotally coupled with leg 401 or leg 402.

The foldable stands disclosed herein to make foldable beds. For instance, in some exemplary embodiments, a bed can be made by placing a mattress, a panel, a bed cloth or the like on the first and second supports of foldable stand 100. In some exemplary embodiments, a bed cloth is non-removably coupled with the first and second supports of foldable stand 100 such that the bed cloth can be folded and unfolded along with the foldable stand.

The foldable stands disclosed herein are simple and lightweight They can be folded like an umbrella when not in use. The foldable stands disclosed herein have improved strength and stability. When unfolded and in use, the crossed bars can be locked to prevent the crossed bars from moving relative to each other and thus from folding inwards. The locking of the crossed bars in turn prevents accidental folding of the foldable stand and collapse of the foldable bed.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A foldable stand comprising:

a first support and a second support, each comprising a first portion and a second portion;

a first leg assembly and a second leg assembly, each comprising a pair of crossed bars, wherein:

an upper end of a first crossed bar in the pair of crossed bars of the first leg assembly is pivotally connected to the first portion of the second support;

an upper end of a second crossed bar in the pair of crossed bars of the first leg assembly is pivotally connected to the first portion of the first support;

an upper end of a first crossed bar in the pair of crossed bars of the second leg assembly is pivotally connected to the second portion of the second support; and an upper end of a second crossed bar in the pair of crossed bars of the second leg assembly is pivotally connected to the second portion of the first support; and at least one locking assembly to selectively lock the pair of crossed bars of the first or second leg assembly, thereby allowing the foldable stand to fold and unfold when unlocked and preventing the foldable stand from accidental folding when locked;

wherein the at least one locking assembly comprises a first locking assembly connected to the pair of crossed bars of the first leg assembly to selectively lock the pair of crossed bars of the first leg assembly relative to each other, and wherein the first locking assembly comprises:

a first locking bar pivotally connected to the first crossed bar in the pair of crossed bars of the first leg assembly;

a second locking bar pivotally connected to the second crossed bar in the pair of crossed bars of the first leg assembly, wherein the first and second locking bars are movably coupled with each other, thereby allowing the first locking assembly to adjust its length; and a locking/unlocking mechanism to selectively restrict the first and second locking bars from moving with respect to each other.

2. The foldable stand of claim 1, wherein:

the first locking bar is pivotally connected to the lower end of the first crossed bar; and the second locking bar is pivotally connected to an upper portion of the second crossed bar.

3. The foldable stand of claim 1, wherein:

the first locking bar is pivotally connected to an upper portion of the first crossed bar; and the second locking bar is pivotally connected to the lower end of the second crossed bar.

4. The foldable stand of claim 3, wherein:

one of the first and second locking bars is an outer tubular bar;

the other of the first and second locking bars is an inner bar that is slidably coupled with the outer tubular bar and comprises one or more cuts; and the locking/unlocking mechanism is disposed at the outer tubular bar and comprises a fastener to selectively engage with a cut in the one or more cuts, thereby selectively restricting the first and second locking bars from moving with respect to each other and consequently locking the pair of crossed bars of the first leg assembly.

5. The foldable stand of claim 4, wherein the locking/unlocking mechanism further comprises a button to disengage the fastener from the cut, thereby allowing the first and second locking bars to move relative to each other and consequently allowing the foldable stand to fold and unfold.

6. The foldable stand of claim 4, wherein a cut in the one or more cuts is a slot formed on an edge of the inner bar.

7. The foldable stand of claim 4, wherein at least a portion of the inner bar is tubular and the cut is a hole formed on a side wall of the tubular portion of the inner bar.

8. The foldable stand of claim 1, wherein the first and second leg assemblies are substantially the same.

9. The foldable stand of claim 1, wherein the first or second leg assembly further comprises a first leg, a second leg, a first base and a second base, wherein:

an upper end of the first leg is pivotally connected to the first or second portion of the first support;

a lower end of the first leg is connected to the first base;

a lower end of the first crossed bar is pivotally connected to the first base;

an upper end of the second leg is pivotally connected to the first or second portion of the second support;

a lower end of the second leg is connected to the second base; and a lower end of the second crossed bar is pivotally connected to the second base.

10. The foldable stand of claim 9, wherein:

the upper end of the first or second leg pivots along a first axis substantially parallel to a lateral direction of the foldable stand; and the upper end of the first or second crossed bar pivots along a second axis substantially parallel to a longitudinal direction of the foldable stand.

11. The foldable stand of claim 9, wherein:

the upper end of the first leg is spaced apart from the upper end of the second crossed bar along a longitudinal direction of the foldable stand; and the upper end of the second leg is spaced apart from the upper end of the first crossed bar along the longitudinal direction of the foldable stand.

12. The foldable stand of claim 1, wherein the at least one locking assembly further comprises a second locking assembly connected to the pair of cross bars of the second leg assembly to selectively lock the pair of cross bars of the second leg assembly relative to each other.

13. The foldable stand of claim 12, wherein the second locking assembly is substantially the same as the first locking assembly.

14. The foldable stand of claim 7, wherein the first and second portions of each of the first and second supports are pivotally coupled with each other at proximal sides thereof, thereby allowing the first and second portions to fold and unfold with respect to each other.

15. The foldable stand of claim 14, further comprising a third leg assembly pivotally coupled with the proximal sides of the first and second portions of each of the first and second supports.

16. The foldable stand of claim 15, wherein the third leg assembly comprises:

a pair of crossed legs, one having an upper end pivotally coupled with the proximal sides of the first and second portions of the first support and the other having an upper end pivotally coupled with the proximal sides of the first and second portions of the second support.

17. The foldable stand of claim 16, wherein the third leg assembly further comprises:

a pair of links, each having an upper end coupled with an upper portion of one crossed leg and a lower end coupled with another crossed leg.

18. A foldable stand comprising:

a first support and a second support;

a first leg assembly and a second leg assembly connected to the first and second supports for supporting the first and second supports when the foldable stand is unfold, the first or second leg assembly comprising a first bar, a second bar, a first leg and a second leg, wherein:

the first and second bars are pivotally connected with each other at middle portions thereof;

an upper end of the first bar is pivotally connected to the second support;

an upper end of the second bar is pivotally connected to the first support;

an upper end of the first leg is pivotally connected to the first support and spaced apart from the upper end of the second bar along a length direction of the first support;

an upper end of the second leg is pivotally connected to the second support and spaced apart from the upper end of the first bar along a length direction of the second support;

a lower end of the first bar and a lower end of the first leg are pivotally connected to each other; and a lower end of the second bar and a lower end of the second leg are pivotally connected to each other; and a locking assembly having a first end pivotally connected to the first bar and a second end pivotally connected to the second bar, wherein the locking assembly has a length that is selectively adjustable, thereby allowing the foldable stand to fold and unfold and preventing the foldable stand from accidental folding.

* * * * *